US006667754B2

(12) United States Patent
Sumi et al.

(10) Patent No.: US 6,667,754 B2
(45) Date of Patent: Dec. 23, 2003

(54) HEAT DEVELOPING APPARATUS

(75) Inventors: Makoto Sumi, Tokyo (JP); Akira Taguchi, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/096,980

(22) Filed: Mar. 12, 2002

(65) Prior Publication Data

US 2002/0135657 A1 Sep. 26, 2002

(30) Foreign Application Priority Data

Mar. 21, 2001 (JP) ..... 2001-080357
Mar. 21, 2001 (JP) ..... 2001-080358

(51) Int. Cl.[7] ..... G03C 1/498; G03D 13/00
(52) U.S. Cl. ..... 347/228; 396/575
(58) Field of Search ..... 347/140, 228; 219/216, 385, 388; 399/335; 396/575; 430/97, 99

(56) References Cited

U.S. PATENT DOCUMENTS 4,864,352 A * 9/1989 Morita ..... 355/27
5,975,772 A * 11/1999 Imai et al. ..... 396/575
6,300,053 B1 * 10/2001 Fujiwara et al. ..... 430/619

FOREIGN PATENT DOCUMENTS

JP 57-27260 * 2/1982 ..... G03D/13/00
JP 4-131847 * 5/1992 ..... G03D/13/00
JP 5-224384 * 9/1993 ..... G03D/13/00
JP 11-119405 * 4/1999 ..... G03D/13/00

* cited by examiner

*Primary Examiner*—Huan Tran
(74) *Attorney, Agent, or Firm*—Squire, Sanders & Dempsey, L.L.P.

(57) ABSTRACT

In a heat developing apparatus having a heat applying member to thermally developing a photothermographic element by bringing the heat applying member into contact with the photothermographic element conveyed at a predetermined processing speed, and a guide surface to guide the element to a developing section, or a guide surface to guide the element from the developing section to the downstream portion in the developing section covered by a housing, at least either one of the guide surfaces is structured by a material having a low heat conductivity such as, for example, a heat insulating material.

21 Claims, 9 Drawing Sheets

FIG. 2 ( a )
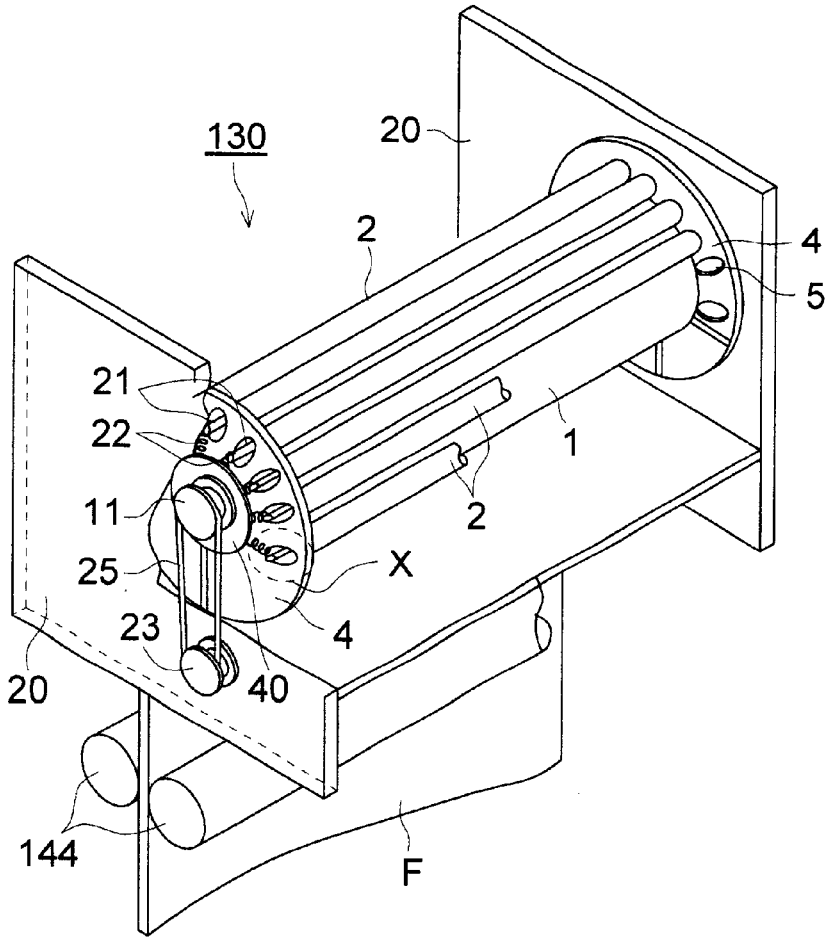
FIG. 2 ( b )
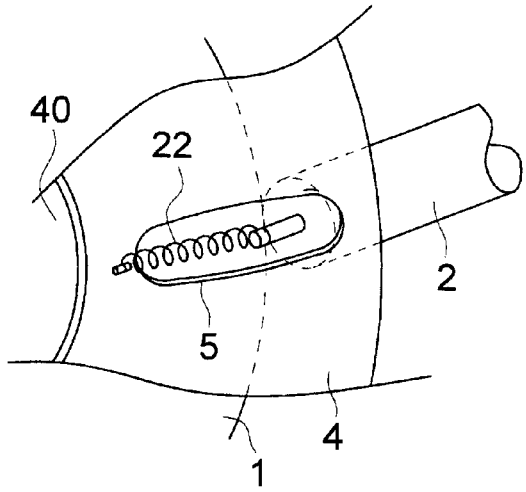

FIG. 3 ( a )
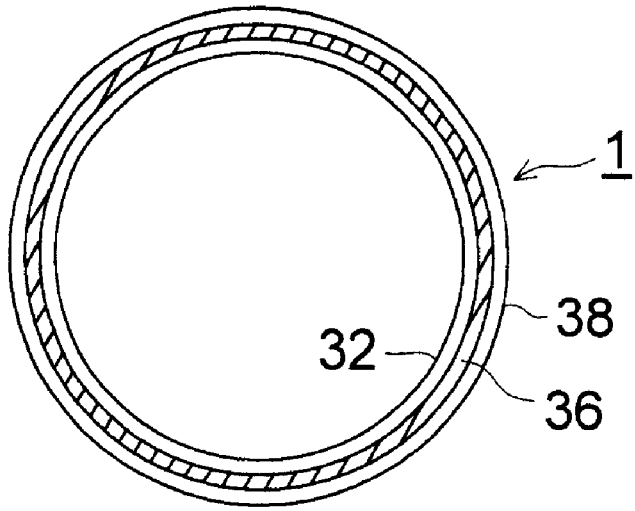
FIG. 3 ( b )
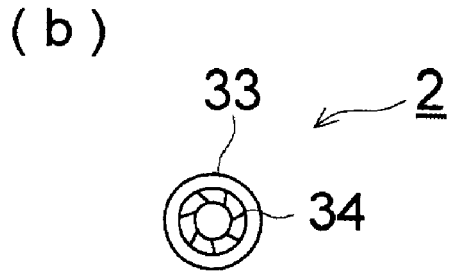

HEAT DEVELOPING APPARATUS

BACKGROUND OF THE INVENTION

The present invention relates to a heat developing apparatus by which a photothermographic element is heated and developed, and particularly to a countermeasure by which the image quality of the element conveyed, is not badly affected by the condensates from gas generated at the heat developing apparatus, and further, to the collection and recovery of the condensates from gas generated at the heat developing apparatus.

In the heat developing apparatus by which the photothermographic element is heat-developed, an exposed photothermographic element is nipped between a drum-like heat applying member (heat drum) which is temperature controlled to a predetermined heat developing temperature, and an urging member (opposite roller) opposite to this member, and the element is heated while the heat applying member is rotated in the held status. After that, the photothermographic element is separated from the heat applying member, cooled and the heat development is stopped, and the photothermographic element is conveyed to the delivery direction. The photothermographic element is heat developed through such the process.

As described above, in the heat developing apparatus, in order to obtain a desired developing density, the predetermined thermal energy is given to the photothermographic element for a predetermined time.

On the one hand, in the photothermographic element, the photosensitive silver halide, organic acid silver salt, binder, and other various additives or solvents are contained.

As repeating the developing processing, when the heat applying member (heat drum) or urging member (opposite roller) and photothermographic element are in contact with each other at the high temperature condition, the material contained in the photothermographic element or the organic acid isolated from the organic acid silver salt is transferred onto the heat drum or the opposite roller, vaporized or decomposed and after that, accumulated inside the heat developing section as condensates from gas, and thereby, the image defect or density lowering occurs. Accordingly, after the processing of a predetermined amount or a predetermined period of photothermographic element, the maintenance washing of the heat developing apparatus has been necessary.

Further, in order to increase the nipping and conveying performance under the high temperature, the elastic body is used for the surface of the heat drum or opposite roller in many cases, and in such the case, there are problems that the composition of the elastic body is deteriorated due to the deterioration by the heat or the material generated from the film, and the strength of the elastic body itself is lowered, further, when the organic solvent type cleaning agent is used for removing the accumulated foreign matter, the crack is generated on the elastic body itself, or the life of the elastic body itself is reduced.

SUMMARY OF THE INVENTION

The first object of the present invention is to minimize foreign matter such as the condensates from gas generated at a developing section, accumulated on a guide member particularly to guide the photothermographic element from upstream into the developing section, or to guide from the inside of the developing section to downstream.

The second object of the present invention is to minimize foreign matter such as the condensates from gas generated at a developing section accumulated on the surface of members inside the heat developing section and members on their periphery.

The first object is attained by any one of the following structures (1) to (12).

(1) A heat developing apparatus which is characterized in that in the heat developing apparatus having a heat applying member to conduct the heat developing by heating a photothermographic element in a developing station, and a guide member to guide the element to the developing section, or a guide member to guide the element from the developing section to the downstream portion in the developing station covered by a housing, at least either one of surfaces of the guide members is structured by a material having a low heat conductivity such as, for example, a heat insulating material.

(2) A heat developing apparatus according to (1), wherein an exhaust apparatus is connected to the developing section, and a suction air portion from the developing section is in the vicinity of an installation position of at least either one of the guide members.

(3) A heat developing apparatus according to any one of (1) or (2), wherein the guide members are exposed outside the developing section.

(4) A heat developing apparatus according to (3), wherein the heat conductivity of each of the guide members is not larger than 1 W/(m·K).

(5) A heat developing apparatus according to any one of (1) to (4), wherein the material of each of the guide members is a resin material or a rubber-like elastic body.

(6) A heat developing apparatus which is characterized in that: in the heat developing apparatus having a heat applying member to conduct the heat developing by heating a photothermographic element in a developing station, and a guide member to guide the element into the developing station, or a guide member to guide the element from the developing section to the downstream portion in the developing station covered by a housing, there is arranged a heat applying means for maintaining at least either the guide member to guide the element into the developing station, or the guide member to guide from the developing station to the downstream portion, at not lower than 80° C.

(7) A heat developing apparatus which is characterized in that: in the heat developing apparatus having a heat applying member to conduct the heat developing by heating a photothermographic element in a developing station, and a guide member to guide the element into the developing station, or a guide member to guide from the developing station to the downstream portion in the developing station covered by a housing, there is arranged a heat applying means for maintaining the difference between the heat developing temperature and the temperature of at least either the guide member to guide the element into the developing station, or the guide member to guide the element from the developing station to the downstream portion, at not higher than 50° C.

(8) A heat developing apparatus which is characterized in that: in the heat developing apparatus having a heat applying member to conduct the heat developing by heating a photothermographic element in a developing station, and a guide member to guide the element into the developing station, or a guide member to guide from the developing station to the downstream portion in the developing station covered by a housing, there is arranged that at least either the guide member to guide the element into the developing station, or the guide member to guide the element from the developing station to the downstream portion, does not directly face the heat applying member.

(9) A heat developing apparatus according to (6), wherein the shielding member is arranged so that the path of the element passing on the guide member does not directly face the heat applying member.

(10) A heat developing apparatus according to (9), wherein the shielding member is arranged from the leading edge portion of the guide member in the conveying direction to the downstream of the guide member in the conveying quad direction.

(11) A heat developing apparatus according to any one of (8), (9) or (10), wherein the shielding member serves also as the guide member.

(12) A heat developing apparatus which is characterized in that: in the heat developing apparatus having a heat applying member to conduct the heat developing by convection heating a photothermographic element conveyed to a developing station, and a guide member to guide the element into the developing station, or a guide member to guide the element from the inside of the developing station to the downstream portion in the developing station covered by a housing, the outside air is taken in from the vicinity of the guide member so that the gas generated from the photothermographic element does not reach at least either the guide member to guide the element into the developing station, or the guide member to guide from the inside of the developing station to the downstream portion.

The second object is attained by any one of the following structures (13) to (22).

(13) A heat developing apparatus which is characterized in that: in the heat developing apparatus having a heat applying member to conduct the heat developing by convection heating a photothermographic element in the developing station covered by a housing, an accumulation member for solidifying or precipitating a gas is arranged in the housing.

(14) A heat developing apparatus according to (13), wherein the accumulation member is structured by the material having the high heat conductivity.

(15) A heat developing apparatus according to any one of (13) or (14), wherein the accumulation member is provided with a cooling structure or cooling apparatus for cooling the accumulation member.

(16) A heat developing apparatus according to (15), wherein the temperature of the accumulation member is made not higher than 80° C. by the cooling structure or cooling apparatus.

(17) A heat developing apparatus according to (15), wherein the temperature of the accumulation is made lower than the heat developing temperature by not smaller than 40° C. by using the cooling structure or cooling apparatus.

(18) A heat developing apparatus according to any one of (13)–(17), wherein the accumulation member is made detachable.

(19) A heat developing apparatus according to any one of (13)–(18), wherein the accumulation member is disposed on the lower side of the passing path of the photothermographic element.

(20) A heat developing apparatus according to any one of (13)–(18), wherein the accumulation member is on the upper side of the passing path of the photothermographic element, and is provided with a liquid dripping prevention means for preventing liquid collected on the accumulation member from dripping to the element.

(21) A heat developing apparatus according to any one of (13)–(18), wherein the accumulation member serves also as the guide member for guiding the photothermographic element.

(22) A heat developing method which is characterized in that: in the heat developing method by which the photothermographic element is nipped and conveyed at a predetermined speed by a heat applying means to apply the heat to a photothermographic element, and an urging means to urge the element to the heat applying means, and the photothermographic element is developed, an accumulation means of the condensates from gas is arranged in the inside of the heat developing section having the housing covering the heat applying means and urging means.

BRIEF DESCRIPTION OF THE DRAWINGS

FIG. 2(*a*) is a general perspective view and FIG. 2(*b*) is a partially enlarged view of a developing section.

FIGS. 3(*a*) and 3(*b*) are sectional views of a heat drum and an opposite roller, respectively.

DETAILED DESCRIPTION OF THE PREFERRED EMBODIMENT

Embodiments of the present invention will be described below.

Figure 1:
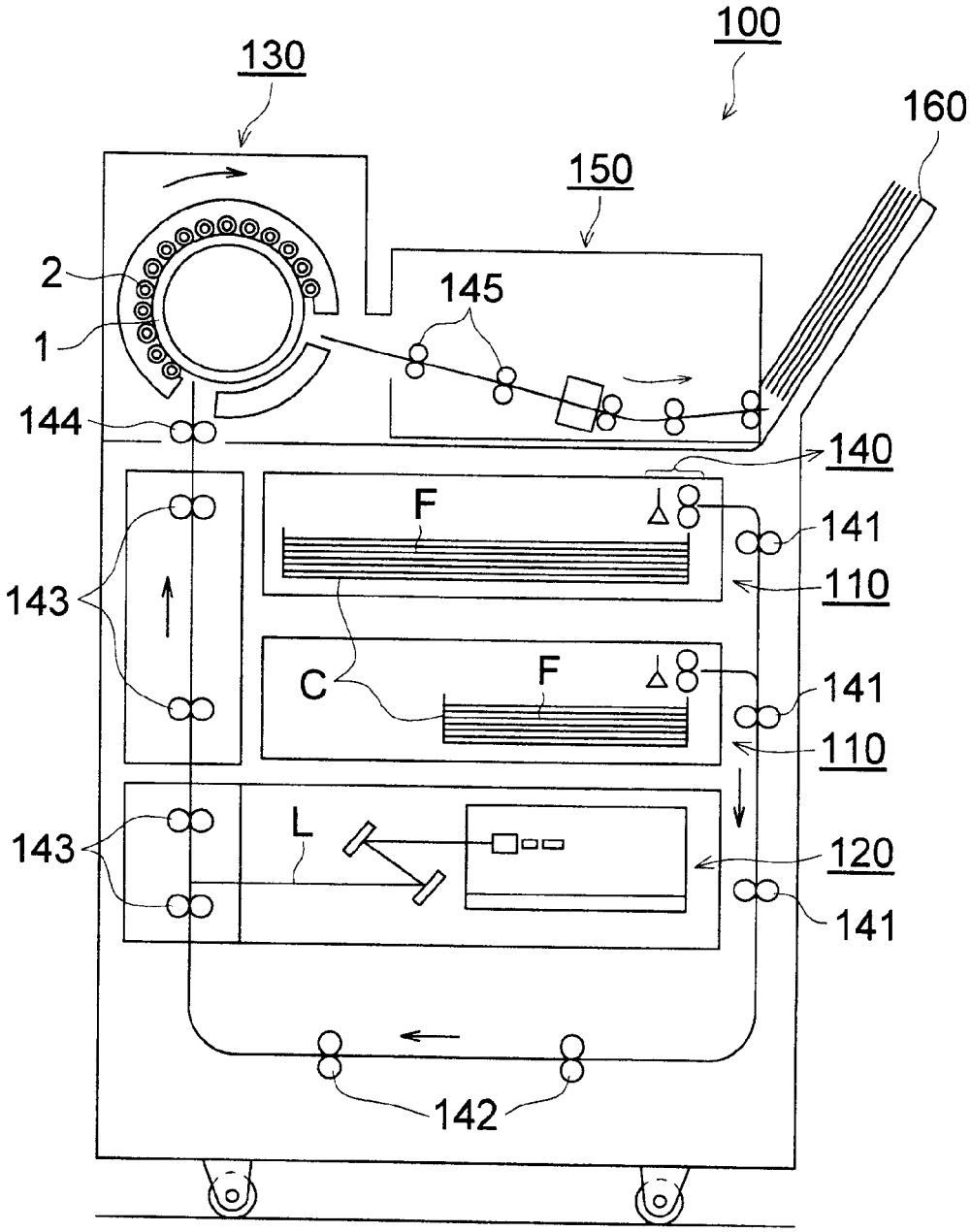
FIG. 1 is a general sectional view of a heat developing apparatus used in the present invention.

FIG. 1 is a general sectional view of a representative heat developing apparatus according to an embodiment of the present invention, and FIG. 2 is a general perspective view showing a structure of a representative developing section.

Referring to FIGS. 1 and 2, the heat developing apparatus will be described below. A heat developing apparatus 100 has a feed section 110 to successively feed a sheet-like photothermographic element (simply called also a film) one by one sheet, an exposure section 120 to expose a fed film F, a developing section 130 to develop the exposed film, and a cooling section 150 to stop the development. The feed section 110 is provided on the upper stage and lower stage, and a film F accommodated in a case C is accommodated for every case C. The film F is taken from the case C by a suction apparatus and conveying roller of a taking apparatus 140, and pulled out in the arrowed direction in the drawing (horizontal right direction). Further, the film F pulled from the case C is conveyed in the arrowed direction (downward) by a conveying apparatus 141 composed of roller pair.

The film F conveyed below the heat developing apparatus 100 is conveyed in the arrowed direction in the drawing (leftward) by the conveying apparatus 142. It is conveyed by a conveying apparatus 143 composed of roller pair from the left side surface of the heat developing apparatus 100 to the arrowed direction (upward), and in that case, in the exposure section 120, it is scanning-exposed by the laser light L in the infrared region (wavelength 780–860 nm), for example, by the laser light of the wavelength 810 nm.

When the film F receives the laser light L, a latent image is formed. After that, the film F is further conveyed in the arrowed direction (upward), and when it reaches the supply roller pair 144, it is supplied to a heat drum 1 as it is. In this manner, in the supply to the heat drum 1, there is also a system in which the supply is conducted at a random timing when the film F reaches the roller, further, when it reaches the roller, the film F is stopped once, and it may be supplied at a predetermined timing. In the latter case, it becomes a system in which the supply roller pair 144 has a function to decide a timing to supply the film F to the heat drum 1 of the developing section 130 rotating at a predetermined rotating speed, and in the case where the drum 1 is rotated to the next supplied position on the one round of the heat drum, when the supply roller pair 144 starts the rotation, the film F is supplied to a predetermined position on the outer periphery of the heat drum 1.

Further, while the heat drum 1 holds the film F on its outer periphery, it rotates in the arrowed direction. In such the condition, the heat drum 1 heats and heat-develops the film F, and forms the visual image from the latent image.

After that, when the heat drum in FIG. 1 is rotated to its rightward, the film F is separated from the heat drum 1, and conveyed in the arrowed direction and after cooled and conveyed by a plurality of conveying roller pair 145 of the cooling section 150, the film F is delivered to the delivery tray 160 so that it can be taken from the upper portion of the heat developing apparatus 100.

FIG. 2(*a*) is a general perspective view showing the inside structure of the developing section 130, and FIG. 2(*b*) is a partially enlarged view of X of FIG. 2(*a*).

The developing section 130 has a heat drum 1 as a heat applying member (which is also a heat applying means) to heat the film F while holding it almost in close contacting with the outer periphery. The heat drum 1 has a function to form the formed latent image as a visual image on the film F by maintaining the film F for a predetermined time at higher than the predetermined lowest heat developing temperature. Herein, the lowest heat developing temperature means the lowest temperature at which the latent image formed on the film F is started to be heat developed, and in the film of the present embodiment, it is more than 100° C. On the one hand, the heat developing time means the time to maintain at higher than the lowest heat developing temperature in order to develop the latent image of the film F into the desired image characteristic. In this connection, a film formed in such a manner that the film F is not practically heat developed at not more than 40° C., is preferable.

On the outside of the heat drum 1, 20 and several rollers of small diameter opposite rollers 2 as the urging member (which is also a urging means) are provided, and they are opposite in parallel to the heat drum 1 and arranged in the peripheral direction of the drum 1 at equal intervals. At both ends of the heat drum 1, guide brackets 4 supported by the frame 20 are provided on both sides.

On each of guide brackets 4, a long hole 5 extending in the radial direction is formed. From this long hole 5, shafts 21 provided at both end portions of the opposite roller 2 are protruded. To the shaft 21, one end of a coil spring 22 is respectively attached, and the other end of the coil spring 22 is attached to the vicinity of the inside edge of the guide bracket 4. Accordingly, each of opposite rollers 2 is urged to the outer periphery of the heat drum 1 by a predetermined force based on the urging force of the coil spring 22. The film F, when it enters between the outer periphery of the heat drum 1 and the opposite rollers 2, is pressed onto the outer peripheral surface of the heat drum 1 with a predetermined force, thereby, the film F can be uniformly heated all over the surface.

The shaft 11 coaxially connected with the heat drum 1, extends outside of the end portion of the frame 20, and by the shaft bearing 40, it is rotatbly supported by the frame 20. On a rotation axis 23 of a micro step motor (not shown) which is arranged below the shaft 11, and attached onto the frame 20, a gear (not shown) is formed. On the one hand, a gear is formed also on the shaft 11. Trough a timing belt (belt on which a gear is provided) 25 which connects both gears, the motive power of the micro step motor is transmitted to the shaft 11, thereby, the heat drum 1 is rotated. In this connection, the transmission of the motive power from the rotation axis 23 to the shaft 11, may be conducted not through the timing belt, but through a chain or a gear train.

FIGS. 3(*a*) and 3(*b*) show sectional views when the surface of the heat drum and opposite roller is coated by the elastic body. FIG. 3(*a*) is a sectional view of the heat drum 1, and onto the heat drum, an aluminum made support tube 36 which is a metallic support member, and on the inner periphery of the tube, a plate-like heater 32 is attached over the all periphery, and under the control of a control-use electronic apparatus, not shown, it is heated. On the outside of the support tube 36, a flexible elastic body 38 is provided. The elastic body may be indirectly attached onto the support tube 36.

Because the elastic body 38 is used, the film F is in more surely close contact with the heat drum 1 by the opposite roller 2 shown in FIG. 3(*b*). It is preferable that the hardness of the elastic body 38 is not higher than 70 (specially, not higher than 60) in the Shore hardness measured by the durometer.

As a material to form the elastic body, for example, when it is silicon rubber, poly urethane rubber, natural rubber, or a material having the elasticity and heat resistance, it is not specifically limited.

It is preferable that the thickness of the elastic body 38 is within the range from 0.1 mm to 2 mm, and more preferably it is not smaller than 0.4 mm. Further, it is preferable that the fluctuation of the thickness of the elastic body 38 is not larger than 20% (specially, not larger than 10%) on the surface area.

The heater 32 is attached onto the inner periphery of the heat drum, and for example, a foil heater which is etched and resistive, can be used.

The heater control-use electronic apparatus, not shown, can adjust the electric power supplied to the heater 32 corresponding to the temperature information sensed by the temperature detecting means, not shown, arranged in the heat drum 1. When the heater control-use electronic apparatus controls the heater 32, the outer surface temperature adjustment of the heat drum 1 is conducted so that it becomes the temperature appropriate for the development of the specific film F.

In the present embodiment, as the urging member, the rotatable opposite roller 2 is used. However, the other means such as a small movable belt can also be used. In the present embodiment, it is preferable that, as the opposite roller 2, an aluminum tube whose outer diameter is 1–2 cm, and whose wall thickness is 2 mm, is used.

This opposite roller may also be formed of a solid metallic tube, however, its surface may also be coated by the elastic body used for the surface of the heat drum, and in FIG. 3(*b*), a sectional view showing a structure of the opposite roller having the elastic body on its surface is shown. On the surface of the aluminum tube, the elastic body is coated.

When the surface of the opposite roller is coated by the elastic body, the surface of the heat drum may have the above-described elastic body, and further, the surface of the heat drum may also be coated by a harder elastic body.

As described above, in the photothermographic element (film F), the developer, organic acid silver salt, binder, and other various additives or solvents are included, and while development is conducted by the heat developing apparatus, it is exposed in the high temperature of 100° C. to 160° C., and the chemical reaction of the development is conducted. While that time, the heat decomposition due to the exposition of the high temperature, or various phenomena such as gasification, sublimation, peeling, or transferring, occur. A gas which is generated at this time is called a gas body, and the gas body in which it is solidified or precipitated, is called condensates from gas.

Then, after the heat developing processing is conducted for a long period of time, when the heat developing apparatus is disassembled, there can be seen a phenomenon that the elastic body of the heat drum surface or the elastic body of the surface of the opposite roller is discolored, and a foreign matter is accumulated on a portion at which it is seemed that the temperature is low.

Specially, in the consideration of the present inventors, when the condensates from gas generated at the development is adhered to the guide member to guide the photothermographic element to the developing section 130, or the conveying surface of the element of the guide member to guide from the developing section inside to the downstream portion, finally, they adhere to the element and the image quality lowering occurs. Accordingly, even when, as the whole of the inside of the housing, so large condensates adherence is not caused, it is a big problem.

In the above description, in the gas body generated in the development, because it is condensed and adhered when it contacts with a member whose temperature is lower than the heat developing temperature, to the guide member arranged in the vicinity of the heat applying member, coupled with the high gas body density in this vicinity, the condensates from gas easily adheres, and specially, at the temperature not higher than 80° C. which is a melting point of the organic acid, the condensates adherence is large.

Accordingly, to the guide member to guide to the developing section, or the guide member to guide from the developing section inside to the downstream portion, a countermeasure by which the condensates adherence does not occur, is necessary.

Then, after the heat developing processing is conducted for a long period of time, when the heat developing apparatus is disassembled, the condensates from gas adheres and accumulates onto the member inside the heat developing section or a member in its periphery. Or, a phenomenon that the elastic body on its surface is discolored, is seen.

Ordinary, although these maintenance and washing are different depending on the processed amount or using frequency, according to the present invention, because the condensates from gas accumulated inside the heat developing section can be collected and recovered in the shape which is effective and any problem does not occur, and the deterioration of the using elastic body can also be effectively prevented, the good image characteristic can be maintained over a longer period of time.

Next, referring to the drawings appropriately, the embodiment of the present invention will be described.

Initially, even when the developing processing is completed and the temperature of the developing section is lowered, it is necessary that the material having the low heat conductivity, for example, a heat insulating material is used for the guide member so that the temperature of the guide member is not rapidly lowered, and for the material for the guide member, it is preferable that the heat conductivity is lower than 1 W/m·K. As the material which has the low heat conductivity, and which is easy in the processing molding, and which is considerably low cost, there are various kinds of resins. Specifically, poly imide type resin, poly ester type resin, poly carbonate type resin, or poly amide type resin can be listed. Further, as the material which has a slight elasticity, each kind of rubber, for example, silicon rubber, or urethane rubber, can be listed.

Figure 4:
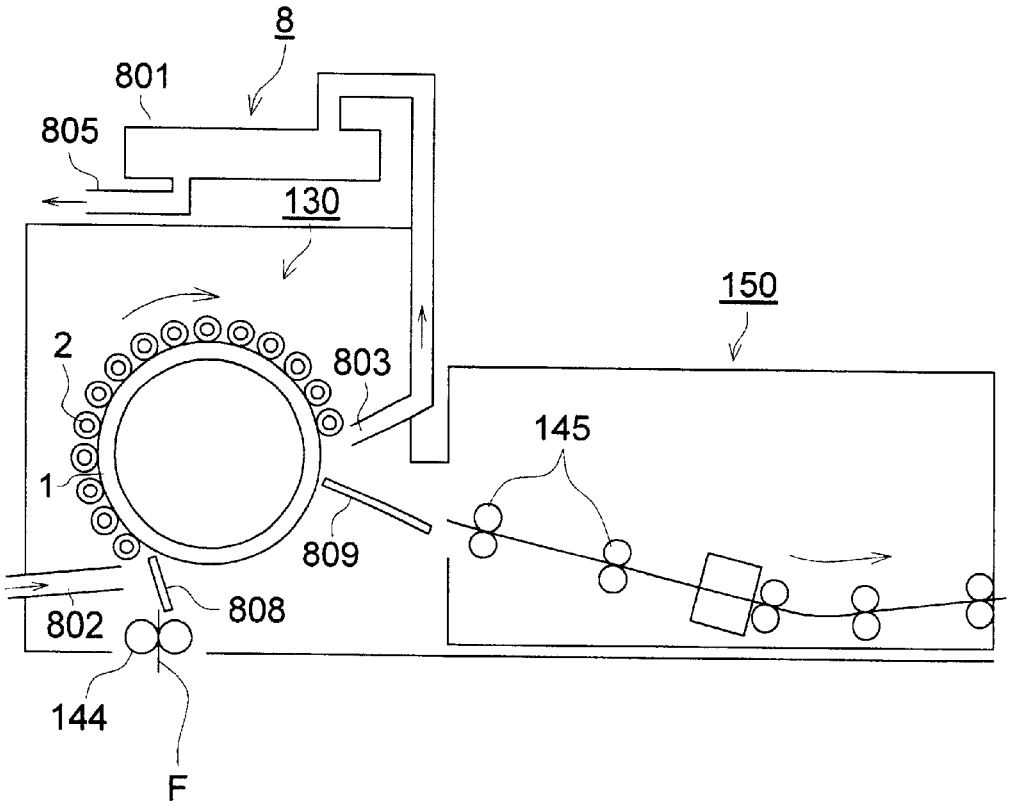
FIG. 4 is a sectional view of an example of an attachment of an exhaust apparatus to the developing section.

Further, it is necessary that the density of the gas body in the developing section is made low as possible. In FIG. 4, an example in which an exhaust apparatus 8 is attached onto the developing section 130 for that purpose, is shown in a cross section. As shown in the drawing, it is preferable that a suction port 803 from the developing section is provided in the vicinity of the guide member (in FIG. 4, it is provided in the vicinity of the guide member 809 guiding the film from the inside of the development section to the downstream portion). Alternatively, as another countermeasure to make the density of the gas body inside the developing section low as possible, it is also an effective countermeasure that an intake 802 of the outside air is provided in the vicinity of the guide plate (in FIG. 4, it is provided in the vicinity of the guide member 808 to guide the film into the developing section). Herein, numeral 801 is a filter, and numeral 805 is an exhaust port to the outside.

In this connection, the vicinity means the nearness at which the gas body density of the contact surface with the guide member, specially, with the photothermographic element can be effectively lowered.

Figure 5:
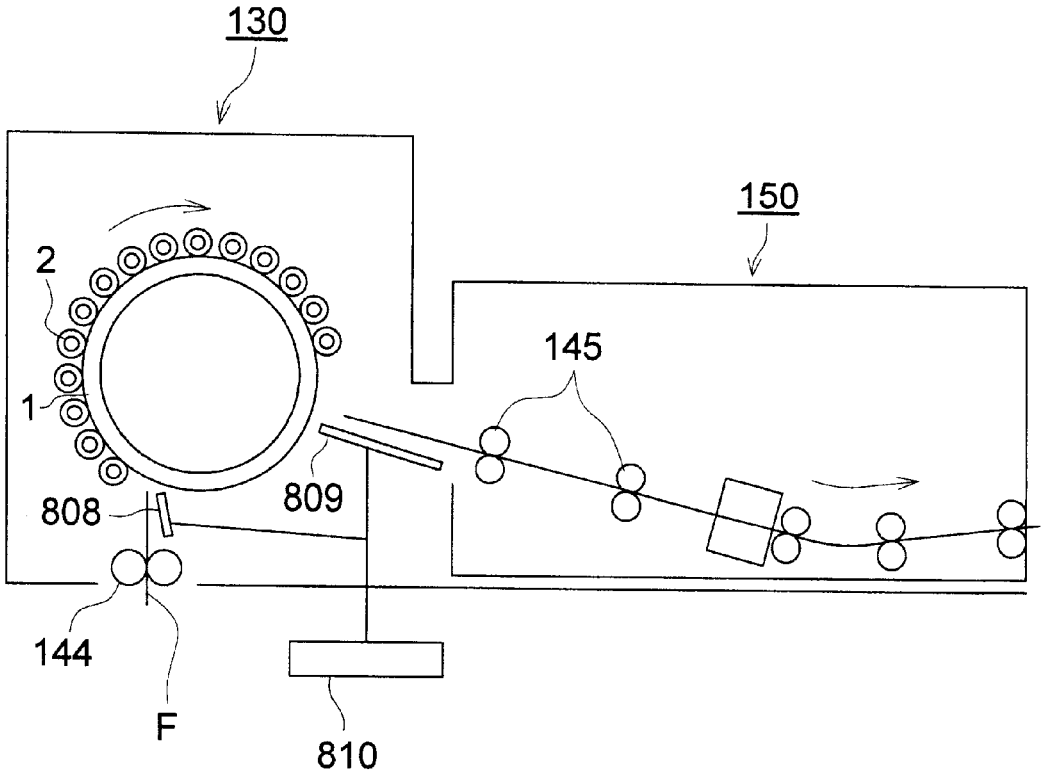
FIG. 5 is a sectional view of an example of the developing section in which a heat applying means is arranged onto a guide member.

Further, as shown in FIG. 5, it is also effective that, onto the guide member 808 to guide to the developing section 130, or the guide member 809 to guide from the inside of the developing section to the downstream portion, the heat applying means 810 is provided and the guide members are maintained at higher than 80° C., or the temperature difference from the heat developing temperature is maintained at lower than 50° C.

Further, there is also a countermeasure by which, in order to make the condensates adherence hardly occur on the contact surface of the photothermographic element with the guide member 808 to guide to the developing section 130, or the guide member 809 to guide from the inside of the developing section to the downstream portion, this surface is made not to directly face to the heat applying member 1, and thereby, the gas body density to reach the contact surface is lowered. Therefore, it is effective that the shielding member of the gas body is arranged.

As the actual embodiment, it is clear that the shielding member of the gas body may be combined with the member having another function.

Figure 6:
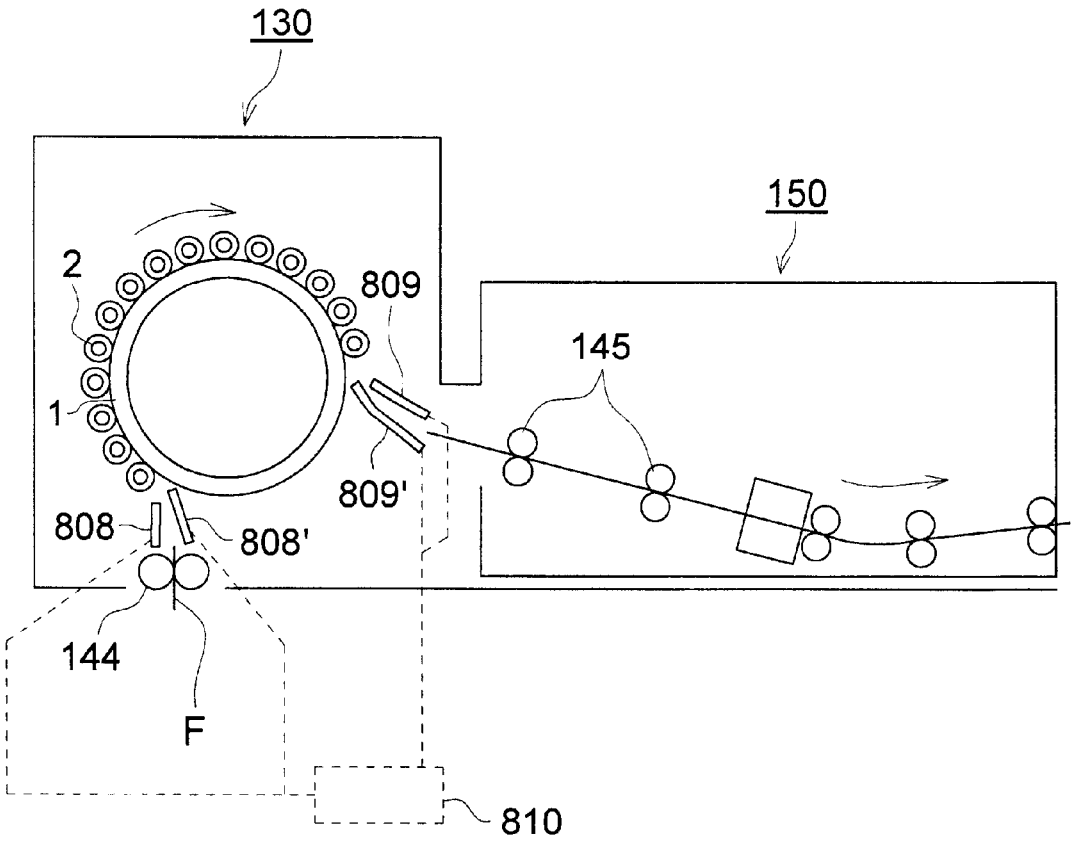
FIG. 6 is a sectional view of an example of the developing section in which a single member of paired guide members is a shielding member.

In FIG. 6, there are guide members 808' and 809' which are paired with the guide members 808 and 809, and an example in which they are combined with a shielding member of the gas body, is shown in the sectional view.

According to the present invention, a method by which a foreign matter such as the condensates from gas is not accumulated onto the guide member to guide the photothermographic element into the developing section, or onto the guide member to guide from the inside of the developing section to the downstream portion, can be provided, and the heat developing apparatus by which the guide member is maintained clean, and a fine image can be obtained for a long period of time, can be provided.

Figure 7:
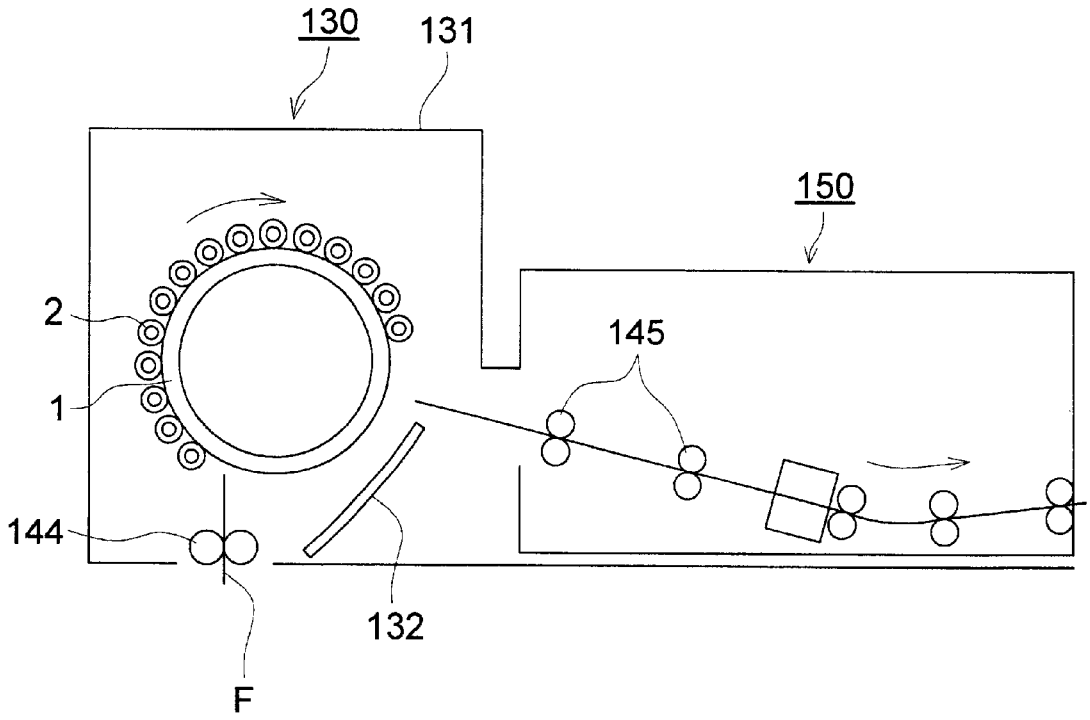
FIG. 7 is a sectional view of a developing section in which an accumulation member (means) is arranged in a housing.

FIG. 7 shows the developing section 130 of the heat developing apparatus according to the present invention, and in its housing 131, a heat drum (heat applying member) 1 and an opposite roller (urging member) 2 is housed.

Then, numeral 132 is an accumulation member (means) of the condensates from gas. As described above, the organic acid separated from the material included in the photothermographic element, or the organic acid silver salt, is transferred onto the heat drum or opposite roller, or after being gasified or decomposed, is accumulated in the inside of the heat developing section as the condensates from gas, and it is a member (means) onto which this condensates from gas is effectively adhered.

As the material of the accumulation member, it is not specially limited, but characteristically, because it is preferable that the material has good heat conductivity and is easily cooled, from this meaning, the metals is preferable. Further, it is also naturally considered that, after the condensates from gas is collected, the present member (means) is taken out and replaced with new member, therefore, it is preferable that it is detachably attached onto the developing section 130. The metals are preferable materials also from the meaning that the processing molding is comparatively easy, and a low cost material can also be selected, and the detachable integrated member can be easily made.

Figure 8:
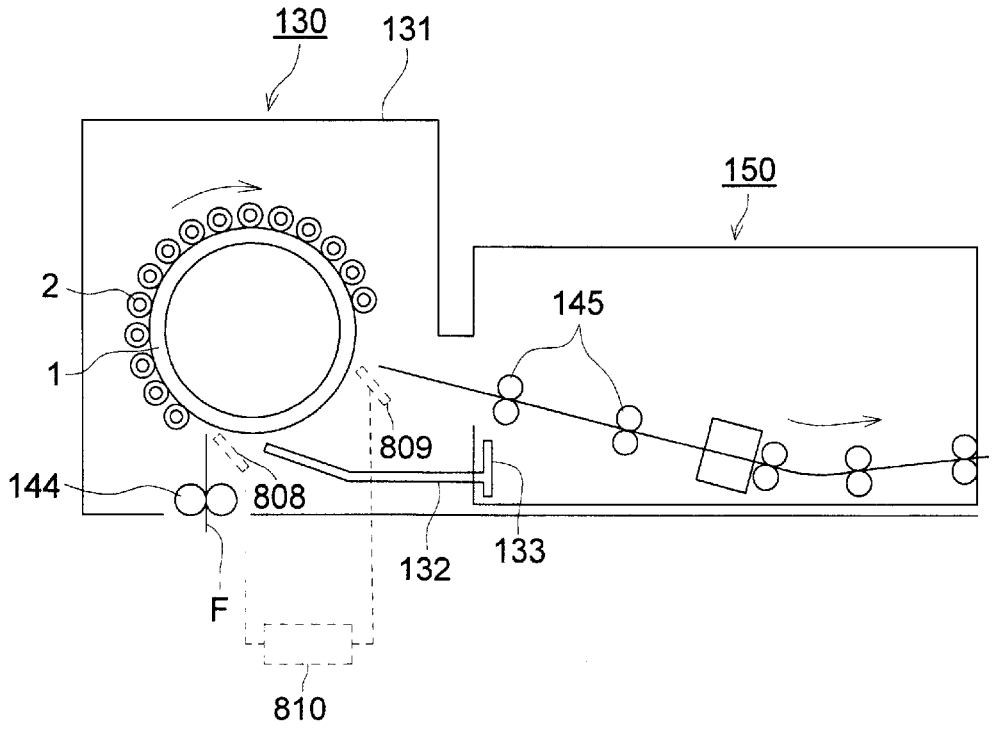
FIG. 8 is a sectional view of another developing section in which the accumulation member (means) is arranged in the housing.

Further, when the condensates from gas is collected, it is preferable that the accumulation member is held at a considerably lower temperature than at least the heat developing temperature in order to easily be condensed. Therefore, it is preferable that the accumulation member has a cooling structure or cooling apparatus. The cooling structure means a structure in which, for example, as shown in FIG. 8, an accumulation member 132 is made of metal having high heat conductivity, and its one end extends to a cooling section 150 and is a cooling temperature section 133, and consequently, the whole of the accumulation member is cooled. Further, the cooling apparatus may also be provided with an exclusive heat exchanger for the accumulation member, and an intake apparatus of the cooling air for cooling the accumulation member may be provided, and for example, an apparatus for hitting the outside air onto the back surface of the accumulation member may be provided. Of course, also in this case, as described above, the cooling air of the cooling section 150 may be utilized.

In any case, it is preferable that, according to the cooling structure or cooling apparatus, the accumulation member, specially, the surface to collect the condensates from gas is at lower than 80° C. Or, it is preferable that the temperature is made lower by the temperature more than 40° C. from the heat developing temperature. In this connection, when the temperature is lowered, it is preferable for the accumulation of the condensates, however, when it is too lowered, there is also a possibility that the bad influence is generated in the developing processing. As a criterion of the lower limit value, it is preferable that it is more than 30° C., or the difference from the heat developing temperature is lower than 90° C.

Further, relating to the arrangement position of the accumulation member in the housing 131 of the developing section 130, specially, there is no limitation. When the accumulation member is taken out, from the point that the condensates from gas drops off, and does not stain the photothermographic element, heat applying member or urging member, for example, as shown in FIGS. 7 and 8, it is preferable that the accumulation member is arranged on the lower side, that is, in the lower portion of the housing 131.

Figure 9:
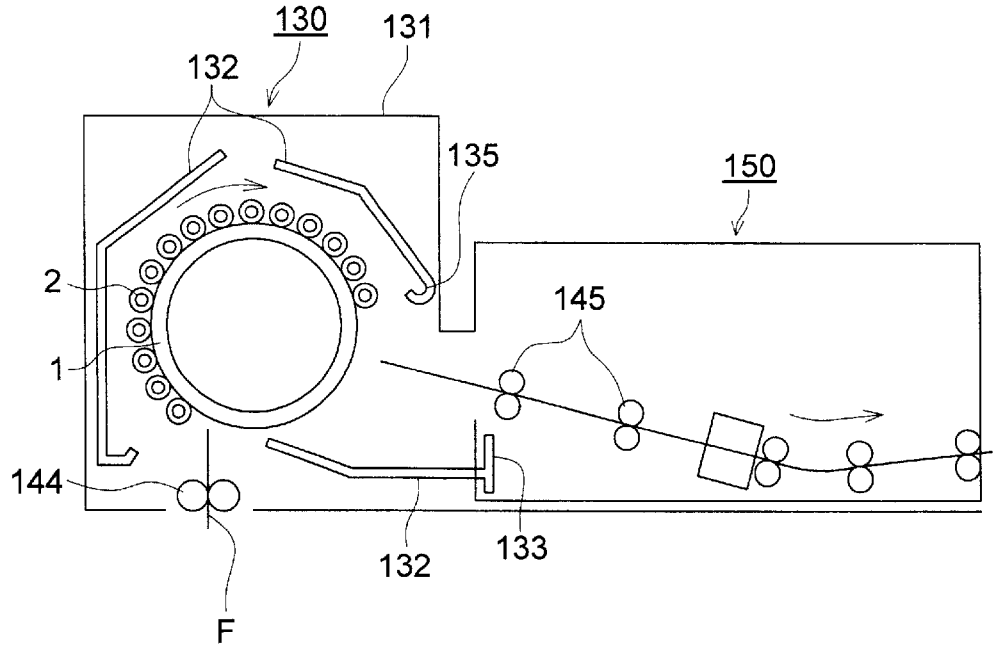
FIG. 9 is a sectional view of yet another developing section in which the accumulation member (means) is arranged in the housing.

However, from the point that the condensates from gas is effectively collected, because the gas body exhausted from the photothermographic element has an inclination to stay in the upper portion of the housing 131, it can also be said it is preferable that it is arranged in its upper portion. However, when it is arranged in the upper portion, it is necessary to provide the shape that the substance in which the gas body is collected by the accumulation member, and condensed into the liquid, does not drop on the photothermographic element, and there is case in which it is also necessary that the substance is made to drop out of the passing path, or a liquid reservoir is provided in the lower portion of the accumulation member. When there is no such the liquid dripping prevention means, there is also a possibility that it drops on the photothermographic element, and deteriorates the image quality. In FIG. 9, this type one is shown, and a liquid reservoir 135 is provided on the lower end portion of the accumulation member 132.

Figure 10:
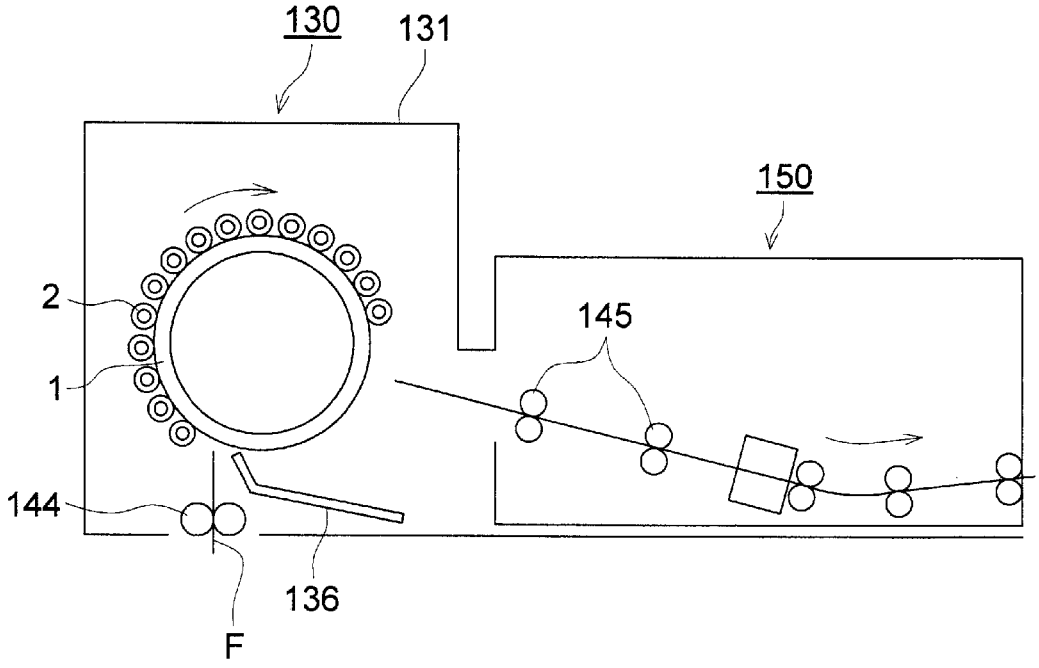
FIG. 10 is a sectional view of a furthermore developing section in which the accumulation member (means) is arranged in the housing.

Further, the accumulation member is combined with other member, and it can also be made the member having a plurality of functions. In FIG. 10, an example in which the accumulation member is combined with a guide plate 136 to introduce the photothermographic element into the developing section 130, is shown.

Incidentally, the guide members 808 and 809, and the heat applying means which are explained in the preferred embodiment shown in FIG. 5, may be provided to the example shown in FIGS. 8 to 10.

According to the preferred embodiment, a method by which the foreign matter such as the condensates from gas is not accumulated on the surface of the member inside the heat developing section and the member existing on its periphery, can be provided, and further, the heat developing apparatus and the heat developing method by which, when the surface of the member is structured by an elastic body, the deterioration of the elastic member does not occur, and the inside of the developing section can be easily maintenance-cleaned, can be provided.

What is claimed is:

1. A thermal developing apparatus comprising:

(a) a developing station covered by a housing;

(b) a heat applying rotatable member for heating a photothermographic element containing a developer, organic acid silver salt, binder, and other various additives or solvents in the developing station; and (c) a plate member provided inside the developing station for guiding the photothermographic element to the heat applying rotatable member, wherein a surface of the plate member is made of a heat insulating material so as to minimize a condensation of the developer, the organic acid silver salt, binder, and the other various additives or solvents which have been accumulated around the surface of the plate member.

2. The thermal developing apparatus of claim 1, further comprising an air exhauster for exhausting air inside the housing.

3. The thermal developing apparatus of claim 2, wherein the air exhauster is connected to the developing station, whose portion inhaling from the developing station is arranged in the vicinity of an installed position of the guide surface.

4. The thermal developing apparatus of claim 3, wherein the heat conductivity of the plate member is not more than 1 W/(m·K).

5. The thermal developing apparatus of claim 1, wherein a material of the plate member is a resin or a resilient rubber.

6. A thermal developing apparatus comprising:

(a) a developing station covered by a housing;

(b) a heat applying member for heating the photothermographic element in the developing station;

(c) a first guide surface for guiding the photothermographic element into the developing station, or a second guide surface for guiding the photothermographic element from the developing station to a downstream section thereof; and (d) a heat applying device for applying heat to at least one of the first and second guide surfaces to maintain a temperature thereof to be not less than 80° C.

7. A thermal developing apparatus comprising:

(a) a developing station covered by a housing;

(b) a heat applying member for heating a photothermographic element being conveyed in the developing station;

(c) a first guide surface for guiding the photothermographic element into the developing station, or a second guide surface for guiding the photothermographic element from the developing station to a downstream section thereof and (d) a heat applying device for applying heat to at least one of the first and second guide surfaces to maintain a difference between a thermal developing temperature and a temperature of at least one of the first and second guide surfaces to be not more than 50° C.

8. A thermal developing apparatus comprising:

(a) a developing station covered by a housing;

(b) a heat applying member for heating a photothermographic element being conveyed in the developing station; and (c) a first guide surface for guiding the photothermographic element into the developing station, or a second guide surface for guiding the photothermographic element from the developing station to a downstream section thereof, wherein at least one of paths of the first and second guide surfaces through which the photothermographic element passes, is disposed so as not to directly face the heat applying member.

9. The thermal developing apparatus of claim 8, further comprising a heat shielding member for shielding the first and second guide surfaces so that each side of the paths of the first and second guide surfaces, does not directly face the heat applying member.

10. The thermal developing apparatus of claim 9, wherein the heat shielding member serves also as the first or second guide surface.

11. The thermal developing apparatus of claim 8, wherein outside air is taken in from the vicinity of each of the guide surfaces so that a gas body generated from the photothermographic element does not reach at least either the first guide surface or the second guide surface.

12. A thermal developing apparatus comprising:

(a) a developing station covered by a housing;

(b) a heat applying member for thermally developing a photothermographic element by convection heating the photothermographic element being conveyed in the developing station at a predetermined processing speed; and (c) an accumulation member provided inside the housing for solidifying or precipitating a gas.

13. The thermal developing apparatus of claim 12, wherein the accumulating member is exposed outside the developing station.

14. The thermal developing apparatus of claim 12, wherein the accumulation member is made of a member having high heat conductivity.

15. The thermal developing apparatus of claim 12, further comprising a cooling structure or a cooling device for cooling the accumulation member.

16. The thermal developing apparatus of claim 15, wherein a temperature of the accumulation member is maintained to be not more than 80° C. using the cooling structure or the cooling device.

17. The thermal developing apparatus of claim 15, wherein a temperature of the accumulation member is made lower than a temperature of a thermal development by not less than 40° C. using the cooling structure or the cooling device.

18. The thermal developing apparatus of claim 12, wherein the accumulation member is dismountable.

19. The thermal developing apparatus of claim 12, wherein the accumulation member is located below a path plane of the photothermographic element.

20. The thermal developing apparatus of claim 12, further comprising a liquid dripping preventive device provided on the accumulation member for preventing a liquid from dripping on the photothermographic element, and the accumulation member is located above a path plane of the photothermographic element.

21. The thermal developing apparatus of claim 12, wherein the accumulation member serves also as a guide surface for guiding the photothermographic element.

* * * * *